United States Patent [19]

Braund et al.

[11] 4,023,879

[45] May 17, 1977

[54] ADJUSTABLE ELECTRICAL CONNECTOR WITH REPLACEABLE CONTACT SUB-ASSEMBLY AND VARIABLE STRAIN RELIEF

[75] Inventors: Kenneth W. Braund, Willoughby; John T. Venaleck, Painesville, both of Ohio

[73] Assignee: A.P. Products Incorporated, Painsville, Ohio

[22] Filed: Oct. 20, 1975

[21] Appl. No.: 623,673

[52] U.S. Cl. ..... 339/31 R; 339/17 F

[51] Int. Cl.[2] ..... H01R 29/00

[58] Field of Search ..... 339/17 F, 31, 176 MF

[56] References Cited

UNITED STATES PATENTS

| | | | |
|---|---|---|---|
| 3,089,114 | 5/1963 | Cole et al. | 339/17 F |
| 3,277,425 | 10/1966 | Marshall et al. | 339/176 MF |
| 3,727,170 | 4/1973 | Mosier et al. | 339/176 MF |
| 3,737,833 | 6/1973 | Jerominek | 339/17 F |
| 3,864,011 | 2/1975 | Huber | 339/17 F |

*Primary Examiner*—Gerald A. Dost

*Attorney, Agent, or Firm*—Donnelly, Maky, Renner & Otto

[57] ABSTRACT

A socket-type electrical connector adaptable for use with connector pins having different size and spacing parameters and with different size electrical cables includes a housing in which a replaceable contact sub-assembly and replaceable strain relief element are located. The contact sub-assembly includes an interstitial contact carrier support member on which are positioned a plurality of bow contacts in opposed parallel rows. The strain relief mechanism includes a pair of aligned opposed cavities, one in each of a pair of opposed housing parts, such cavities opening toward one another and the insert element in the form of a T-shape cross-section elongated member is positioned in one of the cavities for establishing a tortuous path for the electrical cable upon entry into the housing, whereby the electrical cable is at least frictionally retained in the housing by the strain relief mechanism.

14 Claims, 9 Drawing Figures

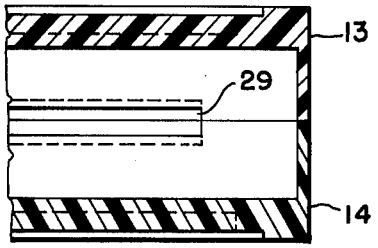
FIG. 6
FIG. 7a
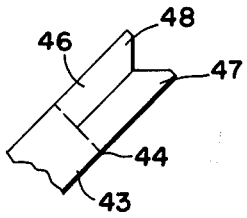
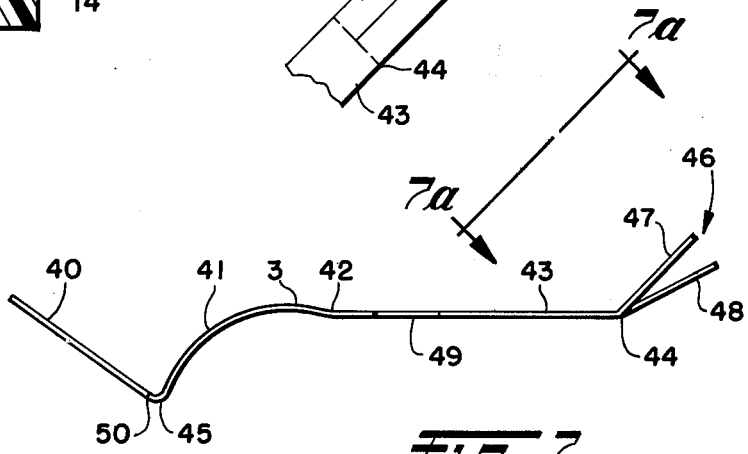
FIG. 7
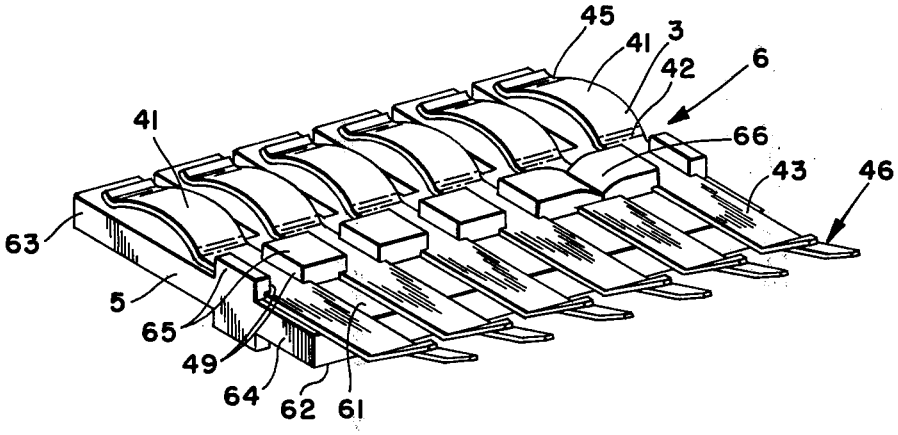
FIG. 8

ADJUSTABLE ELECTRICAL CONNECTOR WITH REPLACEABLE CONTACT SUB-ASSEMBLY AND VARIABLE STRAIN RELIEF

BACKGROUND OF THE INVENTION

This invention relates to socket-type electrical connectors for establishing electrical connections between conductors therein and respective inserted members, such as connector pins or the like on a plug-in electrical connector, circuits on a printed circuit board, or the like, and more particularly relates to a socket-type electrical connector easily adaptable for use with connector pins of various sizes and spacing and to a strain relief mechanism for retention of electrical cables of various sizes.

Plug and socket-type electrical connectors are known in the prior art for establishing electrical connections between respective conductors in two electrical cables, printed circuit boards, or the like. Such prior art connectors usually include a housing into which the electrical cable enters by way of a strain relief mechanism. In the housing the conductor or conductors of the cable or printed circuit board are electrically coupled to respective contacts in a female socket-type connector or to respective connector pins in a male plug-type connector, the position locations and size parameters of the socket connector contacts corresponding to those of the plug connector pin. The size of the contacts and connector pins used depends on the power of signals transmitted therethrough, whereby larger contacts and pins are required for high power signals than for low power signals.

Among the disadvantages with the prior art socket-type connectors are their limitation to accommodate only one connector pin size within certain tolerances and limited capacity for effective strain relief retention of an electrical cable of only a single size, also within relatively narrow tolerances. Therefore, the prior art connectors are limited to relatively specific uses and large inventories are required to provide on hand capability for several uses, particularly depending on plug and cable sizes and electrical power levels. Another disadvantage with such electrical connectors are the mechanical stress created at the tail or attaching end of the contact where it is attached to a printed circuit board, connector or the like, which stress may contribute to solder creep or the like and the eventual failure of the contact connection, especially when the contact is deformed beyond its prescribed limit; and in many prior art connectors the connections between inserted connector pins and respective contacts are only point or line connections which often may be an impediment to efficient current flow.

CROSS-REFERENCE TO RELATED APPLICATION

A particular bow contact for use in socket-type electrical connectors which overcomes several of the last-mentioned disadvantages of prior art connectors is disclosed in U.S. Pat. application Ser. No. 480,695 filed June 19, 1974 for "Bow Contact and Connector Using the Same," which patent application is assigned to the same assignee as the instant application. The bow contact disclosed in such patent application includes a bow portion for connection with an inserted connector pin and a tail portion for attachment to conductors on a printed circuit board and/or from an electrical cable. The bow contact is designed so that over a relatively wide range of deformations of the bow portion by a connector pin inserted in the connector and engaged with such bow portion, the tail portion remains stress free eliminating the above-mentioned contribution to solder creep and increasing the useful life of the connector.

SUMMARY OF THE INVENTION

The socket-type electrical connector of the instant invention overcomes the above-mentioned and other disadvantages by using a standard size housing with replaceble sub-assemblies of different size and contact spacing parameters, each of which includes an interstitial contact carrier support member and a plurality of deformable bow contacts on opposed sides thereof, and standard size strain relief cavities with replaceable inserts of different sizes. The sub-assemblies may be substituted one for another in the housing to adapt the connector to accommodate connector pins of respective size and spacing parameters to achieve optimum connector effectiveness by assuring maximum compliance for use with a wide range of plug connector parameters and a small angle of repose for insensitivity to insertion problems created by misaligned connector pins. Moreover, a balance of the contact forces between the inserted pin rows increases the effectiveness of the connections between respective pins and contacts. The strain relief insert elements of different sizes may be substituted one for another in one of the strain relief cavities to provide effective strain relief retention of electrical cables of different respective sizes. An electrical connector in accordance with the instant invention, for example, will accept for proper strain relief retention twin lead, tri-lead, twisted pair or flat cable wire.

Accordingly, a primary object of the invention is to provide an electrical connector improved in the noted respects.

Another object of the invention is to provide for adjustability in a socket-type electrical connector for use with connector pins of various sizes and spacing.

A further object of the invention is to facilitate connections of electrical conductors to the tail portions of contacts in an electrical connector, such connections being substantially stress free.

An additional object of the invention is to provide for effective strain relief retention of electrical cables of different sizes and shapes in mechanical housings such as electrical connectors or the like.

Still another object of the invention is to provide an electrical connector having a minimum number of different parts to facilitate manufacture and assembly thereof and to reduce the number of parts required to maintain reasonable inventories.

These and other objects and advantages of the instant invention will become apparent as the following description proceeds.

To the accomplishment of the foregoing and related ends, the invention, then, comprises the features hereinafter fully described in the specification and particularly pointed out in the claims, the following description and the annexed drawings setting forth in detail certain illustrative embodiments of the invention, these being indicative, however, of but several of the various ways in which the principles of the invention may be employed.

BRIEF DESCRIPTION OF THE DRAWINGS

In the annexed drawings:

FIG. 6 is a partial section view of the electrical connector of FIG. 1 looking in the direction of arrows 6—6 thereof;

FIG. 7 is an end view of electrical contacts used in the electrical connector of the invention;

FIG. 7*a* is a plan view of the tail portion of one of the electrical contacts of FIG. 7 looking in the direction of the arrows 7*a*—7*a* thereof; and FIG. 8 is an isometric view of a contact sub-assembly used in the electrical connector of the invention.

DESCRIPTION OF THE PREFERRED EMBODIMENT

Figure 1:
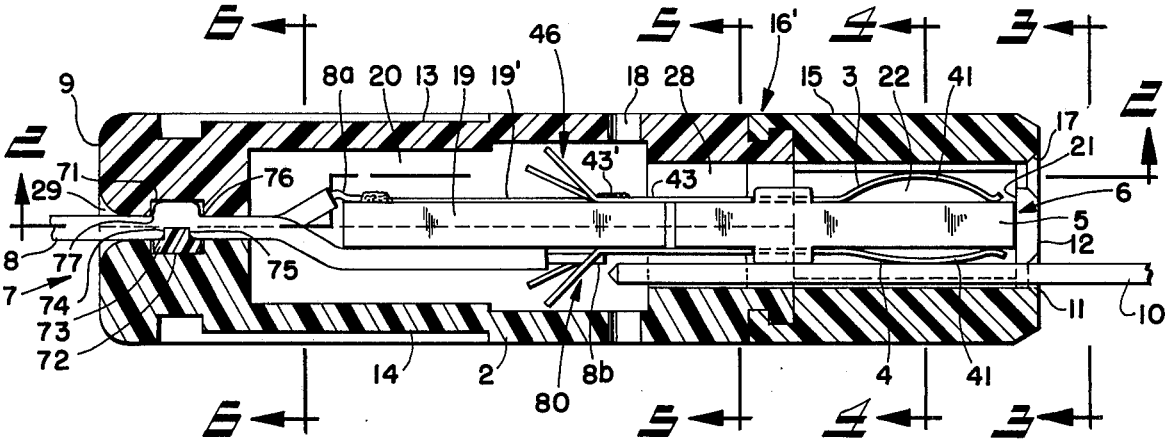
FIG. 1 is a section view with parts in elevation of an electrical connector in accordance with the invention.
Figure 2:
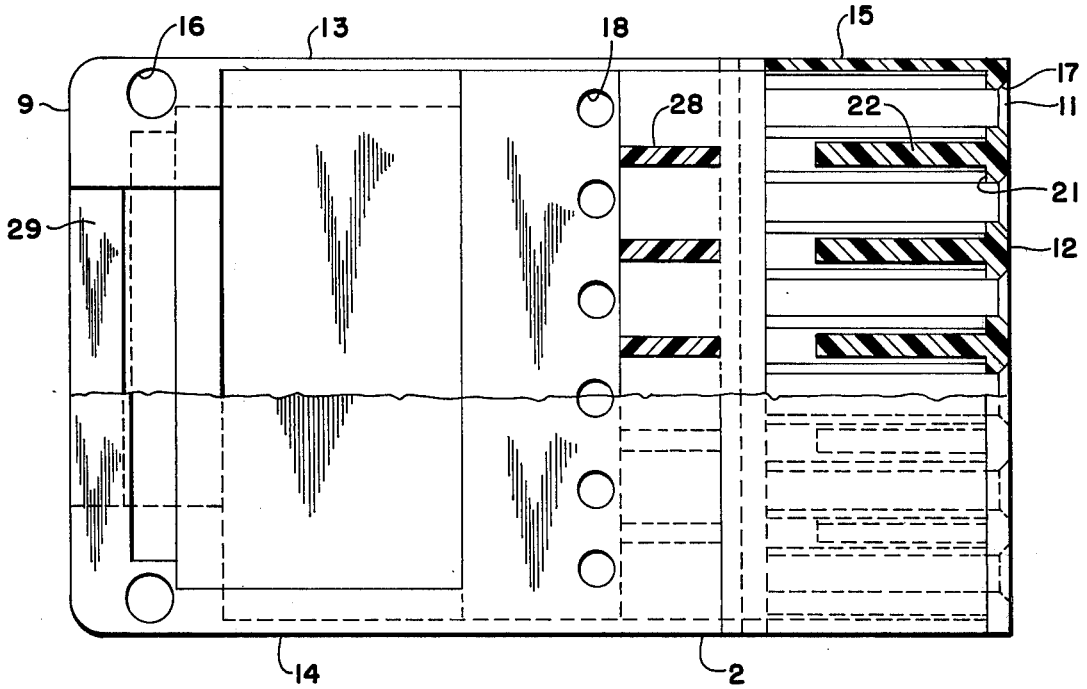
FIG. 2 is a plan view of the bottom of the electrical connector illustrated in FIG. 1 with a portion broken away and looking generally in the direction of the arrows 2—2 of FIG. 1.

Referring now more particularly to the drawings, wherein like reference numerals refer to like elements in the several figures, a socket-type electrical connector in accordance with the invention is generally indicated at 1 in FIG. 1. The electrical connector 1 includes a mechanical housing 2, preferably of electrically non-conductive material such as glass filled Nylon, a plurality of electrical contacts two of which are illustrated at 3, 4 representing opposed rows on opposite sides of an interstitial contact carrier support member 5 and forming therewith a contact sub-assembly 6 of the connector, and a variable strain relief mechanism 7. The electrical connector 1 primarily provides electrical connections between conductors in an electrical cable 8, which enters the rear end 9 of the housing via the strain relief mechanism 7, to respective connector pins 10 from a plug-type electrical connector, not shown, which are inserted in holes 11 in the front end 12 of the housing.

Figure 3:
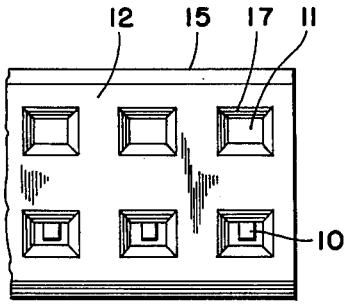
FIG. 3 is a partial front end view of the electrical connector of FIG. 1 looking in the direction of the arrows 3—3 thereof.
Figure 4:
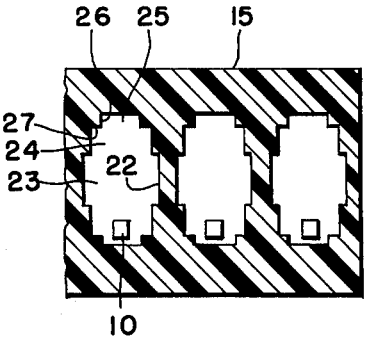
FIG. 4 is a partial section view of the electrical connector of FIG. 1 looking in the direction of arrows 4—4 thereof.
Figure 5:
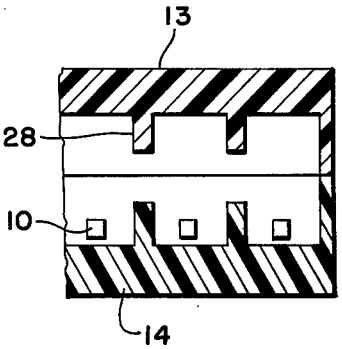
FIG. 5 is a partial section view of the electrical connector of FIG. 1 looking in the direction of arrows 5—5 thereof.

For convenience of illustration and description of the invention, in FIG. 1 only one connector pin 10 is shown inserted in the lower hole 11 in deforming engagement with the lower electrical contact 4, whereas the upper contact 3 is illustrated in its undeformed state. Similarly, in FIGS. 3, 4 and 5 the inserted connector pins 10 are illustrated in their positional relationships to various sections of the lower portion of the housing 2, whereas such pins are not illustrated in position in the upper housing portion. However, in normal use of the electrical connector 1 the front end 12 of the housing 2 will be as illustrated, for example, in FIG. 3 with a plurality of holes 11 arranged in an array or pattern to receive a like number of connector pins from a plug-type electrical connector arranged in a corresponding pattern.

Referring to FIGS. 1 through 6, the mechanical housing 2 includes upper and lower housing parts 13, 14 and a front cap housing part 15, and the parts may be coupled, for example, by rivets or the like indicated at 16 proximate the rear end 9 of the former two parts which are also connected to the cap part by a snap-type T-joint connection generally indicated at 16′. The upper and lower housing parts 13, 14 preferably are identical to reduce the number of parts required for an adequate shelf inventory and to facilitate manufacture and assembly thereof. The plurality of holes 11 in the front end 12 are beveled at their extremities 17 to facilitate insertion of connector pins 10, and a plurality of test openings 18 in the upper and lower housing parts 13, 14 permit insertion of test probes for testing the signals at respective electrical contacts 3, 4 or inserted connector pins 10. A printed circuit board or divider support 19 on which printed circuit conductors or conductive paths 19′ may be formed is engaged between opposed rows of contacts 3, 4 for electrical connection thereto and/or for support and electrical insulation thereof.

The housing 2 provides support for the contact sub-assembly 6 while maintaining the contacts 3, 4 prestressed and electrically insulated from one another and also provides for electrical insulation and guidance for the connector pins 10. Moreover, the substantially enclosed hollow interior 20 of the housing 2 provides a place for undisturbed containment of electrical connections between conductors 8*a*, 8*b* in the cable 8 to the contacts 3, 4. More specifically, within the cap housing part 15, which is preferably a single molded piece, is an inner wall 21 which provides a position stop for the interstitial member 5 and a plurality of divider walls 22 for electrical isolation between respective connector pins 10 especially when they are in engagement with respective contacts 3, 4. Between respective divider walls 22 are relatively large spaces 23 into which the interstitial member 6 fits, narrower spaces 24 within which the electrical contacts 3, 4 fit, and narrowest spaces 25 the side boundaries 26 of which define channel-like areas in which inserted connector pins 10 are directed. Moreover, the land or plateau-like surfaces 27 constitute biasing means for pre-stressing the electrical contacts for reasons to be discussed in more detail below. A plurality of stubs 28 on the upper and lower housing parts 13, 14 provide for further retention of the contact sub-assembly 6 within the housing interior 20, and a slot-like opening 29 in the rear end walls of the housing 2 provides an entrance way for the electrical cable 8 to the housing interior.

Turning now more particularly to FIGS. 7 and 7*a*, one of a row of parallel typical bow contacts 3 for the connector of FIG. 1 is illustrated, the row of bow contacts 4 being similarly formed, and each of the contacts 3 is connected to a common break away stub 40 to facilitate handling and assembly. The bow contact 3 is similar in form and function to the bow contacts disclosed in the above-mentioned copending patent application, which includes a gradually curved bow portion 41 coupled by a relatively sharper reverse-curved transition portion 42 to a substantially linear tail or attaching portion 43. The contact 3 may be full hard beryllium copper with gold nickel finish and is so formed that in free unstressed condition an acute angle is defined between the linear tail portion and a line drawn between the rear or remote end 44 thereof and the front or nose 45. At the remote and 44 of the tail portion is a bent bifurcated tail 46, the bend facilitating insertion of the printed circuit board 19 and the bifurcation facilitating connection of conductors to the same by jamming the conductor into frictional and/or biting engagement between the bifurcated parts 47, 48, as illustrated in the connection of the conductor 8*b* in FIG. 1.

A cut out 49 in the tail portion 43 of the contact 3 facilitates positioning the same on the interstitial member 5, and the nose 45 of the contact is curved to facilitate sliding movement on the interstitial member when the bow portion 41 is deformed as described in more detail below. For convenience of contact manufacturing and contact sub-assembly 6 assembly, a plurality of parallel contacts 3 may be simultaneously stamped or otherwise formed with each being connected at its respective nose 45 to the common break away stub 40, which may be scored at 50 to facilitate removal from the contacts after assembly on the interstitial member 5 for electrical isolation thereof.

The contact-sub-assembly 6 is illustrated in detail in FIG. 8 including a plurality of electrical bow contacts generally indicated at 3 and the interstitial contact carrier support member 5, which may be glass filled Nylon or other electrically non-conductive material. Although for clarity only the contacts 3 are shown on the upper surface 61 of the interstitial member 5, the contacts 4 normally would be similarly found on the lower surface 62 thereof. The interstitial member includes a plurality of fingers 63, which extend generally in a forward direction from a common connecting bar 64, and a plurality of rectangular cross-section stakes 65 between which the respective contacts 3 are positioned and aligned by the positioning cut outs 49 in the latter.

In assembling the contact sub-assembly 6, a plurality of contacts attached at their nose ends 45 by a common break away stub 40 are positioned on the interstitial member 5 with the positioning cut outs 49 and stakes 65 in alignment. A force is preferably applied to the break away stub 40, the contact bow portions 41, and/or the contact tail portions 43 to urge the latter into flat abutting relation relative to the surface 61 or 62 of the interstitial member 5, and the respective stakes 65 may be ultrasonically squashed, for example, by an ultrasonic horn tool or the like for mechanical retention of the respective contacts in position as shown, for example, at 66.

The strain relief mechanism 7, as illustrated most clearly in FIG. 1, includes proximate the slot like opening 29 in the rear end 9 of the housing 2 a pair of aligned substantially same-size cavities 71, 72, one in each of the upper and lower housing parts 13, 14. The cavities extend in a direction parallel to the rear outer wall of the housing 2 and are of a standard size sufficiently large to accommodate the largest size electrical cable 8 with which the connector 1 is intended to be used.

A T-shape cross-section elongated insert element 73 having a length slightly shorter than the length of the cavities 71, 72 is positioned in one of the cavities with the stem of the T facing toward the opposed cavity to create a tortuous path for the electrical cable 8 when the upper and lower housing parts 13, 14 are fastened together. The cross-sectional size of the T-shape insert element 73 is selected so that one or more of the corners 74, 75 of the stem and the corners 76, 77 of the opposed cavity toward which the stem faces bite into the insulation of the electrical cable 8 when the housing parts 13, 14 are fastened to effect secure strain relief retention of the electrical cable. A number of different size and/or cross-sectional configuration insert elements 73 may be held in stock for inclusion and/or substitution in any electrical connector 1 having respective standard size opposed cavities 71, 72 for strain relief retention of respectively different size electrical cables with which the electrical connector 1 is to be used. It is to be understood that although the strain relief mechanism 7 is illustrated and described with reference to application in a socket-type electrical connector, such strain relief mechanism may be used in any apparatus in which different size electrical cables or the like are to be retained in a mechanical housing in strain relief relation, whereby substitution of different size insert elements 73 will provide for effective strain relief retention of respective different size cables or the like.

As described above, the respective conductors of the electrical cable 8 may be directly attached to the contact bifurcated tail 46, as illustrated, for example, at 80 in FIG. 1, and in such arrangement the divider support 19 may be inserted between the opposed rear parts of the contact tail portions 43 for support and electrical isolation thereof. If the contacts are sufficiently strong, however, such divider support 19 may be eliminated. Alternatively, the divider support 19 may be a printed circuit board including a plurality of conductors in the form of printed conductive paths on opposed surfaces thereof, and the respective conductors, such as conductor 8*a*, of the electrical cable 8 are soldered to one end of each printed circuit conductive path. The rearward portions of the contact tails 43 engage against the other ends of the conductive paths, and, if desired, the respective contact tails also may be soldered to the conductive paths, as shown at 43′.

To use the electrical connector 1 selection is first made of a contact sub-assembly 6 which has an interstitial member thickness and contact size suitable for electrical connection with connector pins 10 of a particular size, shape and spacing. For example, large size connector pins usually carry relatively high power signals, which would require correspondingly large size contacts and a somewhat reduced thickness interstitial member so that the respective contacts will be capable of carrying the signals and the respective tail portions thereof will be maintained in a zero stress condition as the bow portions are deformed. Moreover, as the spacing between opposed rows of connector pins increases or decreases, the thickness of the interstitial member 5 should preferably be correspondingly increased or decreased or the configuration of the bow portions of the contacts should be modified and a contact sub-assembly 6 would be selected in accordance with the desired parameters thereof. A similar selection of a proper strain relief insert element 73 is made for adapting the electrical connector 1 for use with a particular size electrical cable.

After the sub-assembly 6 is selected, it is inserted into the housing cap portion 15. The surfaces 27 provide a pre-stress force on the bow portions of the respective contacts to maintain the tail portions thereof at zero stress by remaining in flat relation with the rearward portion of the interstitial member 5 and with the respective surfaces of the also inserted printed circuit board 19. The electrical conductors 8*a* of the electrical cable 8 preferably are previously soldered to respective conductive paths 19′ on the divider support printed circuit board 19, such conductive paths being illustrated in part greatly enlarged for clarity on the upper surface thereof in FIG. 1. The upper and lower housing parts 13, 14 are then snapped or slid into the cap housing part 15 at the T-joint 16′ and the former two housing parts are fastened by the rivets 16.

Insertion of connector pins 10 from a plug-type electrical connector into the holes 11 in the front 12 of the connector 1 causes deformation of the bow portions of respective contacts while the tail portions thereof remain at zero stress as indicated above, and electrical connection is made via the contacts between such pins and conductors coupled at the tail ends of the contacts. More specifically, prior to insertion of a connector pin into deforming engagement with a bow portion of a contact, the housing cap land portion 27 of the housing cap portion 15 biases the bow portion to deform the attaching portion into continued abutment with the surface of the interstitial member 5 while the transition portion becomes pre-stressed with a relatively large moment therein and the attaching portion remains at zero moment. Until the moment in the transition portion is relieved the attaching or tail portion of the contact will remain flat and at zero moment over a relatively wide range of applied forces to and deformations of the bow portion by an inserted connector pin so that any connections to the tail or attaching portion of the contact remains substantially unstressed.

It is to be understood that the parameters of the connector 1 may be modified in order to adapt the same for use with different pins 10 or electrical cables 8. Such modification is readily achieved by separating the housing parts 13, 14, 15 and replacing the contact sub-assembly 6 and/or insert element 73 with corresponding members for proper connector operation with the different size pins or cable.

The embodiments of the invention in which an exclusive property or privilege is claimed are defined as follows:

1. A socket-type electrical connector, comprising an electrically non-conductive housing having an interior compartment and opening means in the former for providing access to the latter; and a contact sub-assembly positioned in said compartment, said contact sub-assembly including electrically conductive bow contact means aligned with said opening means for engaging with an electrically conductive member inserted into the same, said bow contact means comprising a deformable curved bow portion, a reverse curved transition portion and a substantially linear attaching portion, said attaching portion of said bow contact means when in free unstressed condition defining an acute angle with a line drawn between opposed ends of said bow contact means, a substantially planar carrier means for supporting said bow contact means at said attaching portion and at the opposite end of said bow contact means relative to said attaching portion, and said bow contact means being deformable to place said attaching portion in a substantially planar abutting relation with said carrier means, whereby a pre-stressed region of moment is created in said transition portion and said attaching portion is maintained under zero stress as a region of zero moment within a predetermined range of deformations of said bow portion, said contact sub-assembly being removable from said housing for replacement by a similar contact sub-assembly having different size and spacing parameters for effective electrical connection with electrically conductive members of corresponding parameters.

2. A socket-type electrical connector, comprising an electrically non-conductive housing having an interior compartment and opening means in the former for providing access to the latter; and a contact sub-assembly positioned in said compartment, said contact sub-assembly including electrically conductive bow contact means aligned with said opening means for engaging with an electrically conductive member inserted into the same, said bow contact means being attached to a substantially planar carrier means for supporting the same, said contact sub-assembly being removable from said housing for replacement by a similar contact sub-assembly having different size and spacing parameters for effective electrical connection with electrically conductive members of corresponding parameters, said carrier means comprising upper and lower support surfaces of substantially parallel coplanar extent, and said bow contact means comprising respective bow contacts on such support surfaces in opposed parallel rows, each bow contact comprising a deformable curved bow portion, a reverse curved transition portion and a substantially linear attaching portion, said attaching portion of said bow contact when in free unstressed condition defining an acute angle with a line drawn between opposed ends of said bow contact, and said bow contact being deformable to place said attaching portion in a substantially planar abutting relation with the support surface thereof, whereby a pre-stressed region of moment is created in said transition portion and said attaching portion is maintained under zero stress as a region of zero moment within a predetermined range of deformations of said bow portion.

3. A socket-type electrical connector as set forth in claim 2, said carrier means comprising a plurality of upstanding stakes and said bow contacts having corresponding cut outs in the attaching portions thereof to mate with said stakes, and each of said stakes having a squashed portion in engagement with respective bow contacts for mechanical retention of said bow contacts on said carrier means.

4. A socket-type electrical connector as set forth in claim 2, said housing comprising a forward cap portion including a plurality of divider walls separating adjacent opening means, and said carrier means comprising finger-like projections extending in the space between such divider walls and coupled to a common connecting portion, and a bow contact on each of the upper and lower surfaces of each finger-like projection.

5. A socket-type electrical connector as set forth in claim 2, further comprising means in said housing for pre-stressing said bow contacts to maintain the attaching portions thereof at zero stress in flat abutting engagement with said support surface.

6. A socket-type electrical connector as set forth in claim 2, further comprising a printed cicruit board having a plurality of printed circuits thereon, said printed circuit board being positioned between opposed rows of contacts proximate the attaching portions thereof, whereby said attaching portions remain in flat abutting relation with respective circuits printed on said printed circuit board for electrical connection therewith.

7. A socket-type electrical connector as set forth in claim 6, further comprising an electrical cable attached to said housing, said electrical cable including electrical conductors, and means for electrically and mechanically attaching said conductors to respective circuits on said printed circuit board.

8. A socket-type electrical connector as set forth in claim 7, said attaching portions being soldered to respective circuits on said printed circuit board.

9. A socket-type electrical connector as set forth in claim 2, the end of said attaching portion remote from said transition portion of each bow contact comprising a bent bifurcated tail, and an electrical cable attached to said housing, and conductors of said cable being electrically and mechanically attached to respective bifurcated tails.

10. A socket-type electrical connector as set forth in claim 9, further comprising an electrically non-conductive divider support means inserted between the attaching portions of the opposed rows of bow contacts for support and electrical insulation thereof.

11. A socket-type electrical connector, comprising an electrically non-conductive housing having an interior compartment and opening means in the former for providing access to the latter; and a contact sub-assembly positioned in said compartment, said contact sub-assembly including electrically conductive bow contact means aligned with said opening means for engaging with an electrically conductive member inserted into the same, said bow contact means being attached to a substantially planar carrier means for supporting the same, said contact sub-assembly being removable from said housing for replacement by a similar contact sub-assembly having different size and spacing parameters for effective electrical connection with electrically conductive members of corresponding parameters; said housing comprising upper and lower main body portions and a forward cap portion attached to said body portions, said contact sub-assembly being positioned proximate the forward end of said housing and means in the rearward end of said housing for receiving an electrical cable having electrical conductors for electrical coupling to respective bow contact means in said housing.

12. A socket-type electrical connector as set forth in claim 11, said means for receiving comprising a slot in the rear housing wall formed at the juncture of said upper and lower main body portions, and means for retaining said electrical cable in said slot in strain relief relation to prevent damage to connections of said electrical conductors in said housing when a force tending to separate said housing and cable is applied to at least one of the same.

13. A socket-type electrical connector as set forth in claim 12, said means for retaining comprising a pair of opposed aligned cavities, one in each of said upper and lower main body portions on opposite sides of said slot, said cavities opening toward one another, and removable insert means in at least one of said cavities for establishing a tortuous path for said electrical cable, whereby said insert means urges at least a portion of said electrical cable into the other of said cavities for at least frictional engagement with such electrical cable within a designated size range, said insert means being removable and replaceable by a similar insert means of a different size to provide effective retention for electrical cables of a different corresponding size range.

14. A socket-type electrical connector as set forth in claim 13, said cavities being elongated in a direction parallel to the rear wall of said housing, and said insert means having a length approximately equal to that of said recesses and a T-shape cross-section, said insert means being positioned in said at least one cavity whereby the stem of such T extends in a direction toward the other of said cavities.

* * * * *